United States Patent [19]

Erickson

[11] 4,192,462

[45] Mar. 11, 1980

[54] SHIELDED SPRAY APPARATUS

[76] Inventor: Elwyn J. Erickson, 210 6th Ave. NW., Wells, Mich. 55097

[21] Appl. No.: 925,387

[22] Filed: Jul. 17, 1978

[51] Int. Cl.[2] ..... B05B 1/28

[52] U.S. Cl. ..... 239/288; 134/183; 118/326; 4/256

[58] Field of Search ..... 239/288, 288.3, 288.5; 134/182, 183; 15/422

[56] References Cited

U.S. PATENT DOCUMENTS

| | | | |
|---|---|---|---|
| 1,980,099 | 11/1934 | Schacht | 4/256 |
| 3,118,607 | 1/1964 | Rocher | 239/288.3 |
| 3,770,204 | 11/1973 | Schuster | 134/183 |
| 3,850,373 | 11/1974 | Grolitsch | 239/288.5 |

*Primary Examiner*—James B. Marbert

*Attorney, Agent, or Firm*—Burd, Bartz & Gutenkauf

[57] ABSTRACT

A shielded spray apparatus for confined spraying of material, as plaster, paint, varnish or the like, usable to spray a large small area or when spraying is done under a windy environment. The apparatus includes a truncated housing defining an isolated spray chamber. The housing has a large planar open end defined by the forward edges of housing sidewalls. A rear opening in the rear center of the housing is smaller than and coplanar to the forward opening and closed by a flexible panel. The panel has an aperture in which is mounted a portion of the nozzle of a spray gun whereby material sprayed from the spray gun is directed through the chamber of the housing toward the forward open end when the forward open end is placed adjacent a wall or surface.

12 Claims, 7 Drawing Figures

SHIELDED SPRAY APPARATUS

SUMMARY OF THE INVENTION

The invention pertains to the field of spray apparatus for spraying plaster, paint, varnish and the like. Normal spray guns produce a certain amount of unavoidable "over spray" which impinges upon surfaces adjacent to that being sprayed, upon the operator, and generally about the area. When the operator wants to apply material on a localized area, or on only a small object, he may find the over spray objectionable. Also, when a spray gun is used in a windy environment, the wind can have a tendency to blow sprayed particles away from their intended end point to an unintended location.

The invention comprises a shielded spray apparatus for the containment of the spray pattern produced by a spray gun. The apparatus includes a truncated housing or shroud having divergent sidewalls defining a spray chamber with forward edges defining a forward, planar opening to be placed adjacent the surface or location to be sprayed. The housing has a rear opening which is smaller than the forward opening and disposed in aligned, parallel relationship to it. The rear opening is closed by a flexible panel or seal which has an aperture for receipt of the nozzle of the spray gun. The spray nozzle of the spray gun is assembled to the flexible seal and orientated to disperse sprayed product toward the forward end of the chamber. Sprayed product is contained within the chamber and dispersed only upon the surface exposed to the chamber by the forward opening of the housing. The sidewalls of the housing prevent overspray beyond the perimeter of the forward edges. A sealing rim can be disposed along the forward edges of the housing defining the front opening in order to seal a portion of the surface exposed to the forward opening from the adjacent portions of the surface and insure that material is not sprayed upon the adjacent portions.

Filters can be disposed in filter openings on the housing sidewalls to permit expulsion of air from the chamber as the spray gun is operated. The filters clean the air as it exits the chamber and filters out particles of sprayed product. One or more handles are secured to the outside of the housing walls, and in conjunction with the handle of the spray gun are used to manipulate the apparatus. The flexible mount of the spray gun by the flexible panel permits a degree of pointing or aiming of the spray gun to insure that the entire surface encompassed by the front opening of the housing is fully sprayed.

IN THE DRAWINGS

DESCRIPTION OF PREFERRED EMBODIMENT

Figure 1:
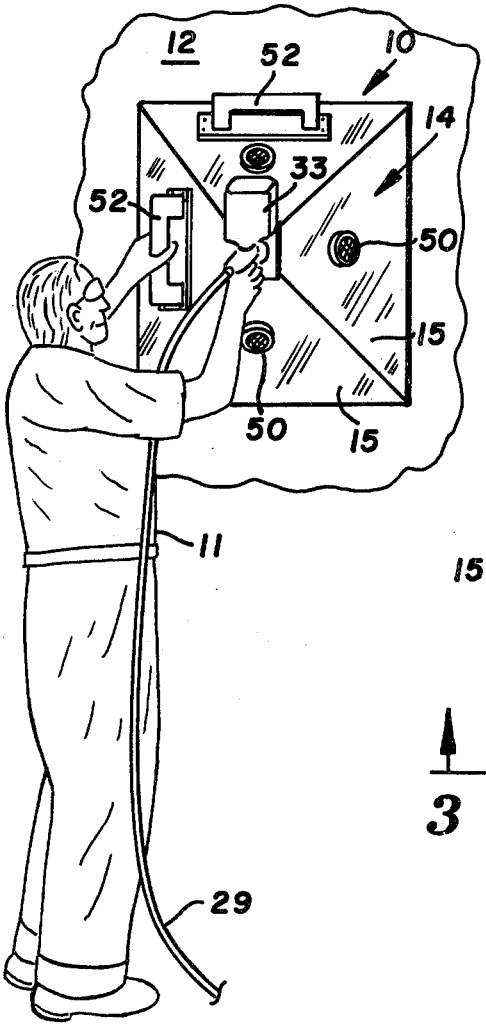
FIG. 1 is a perspective view of a painter operating a shielded spray apparatus of the invention.
Figure 2:
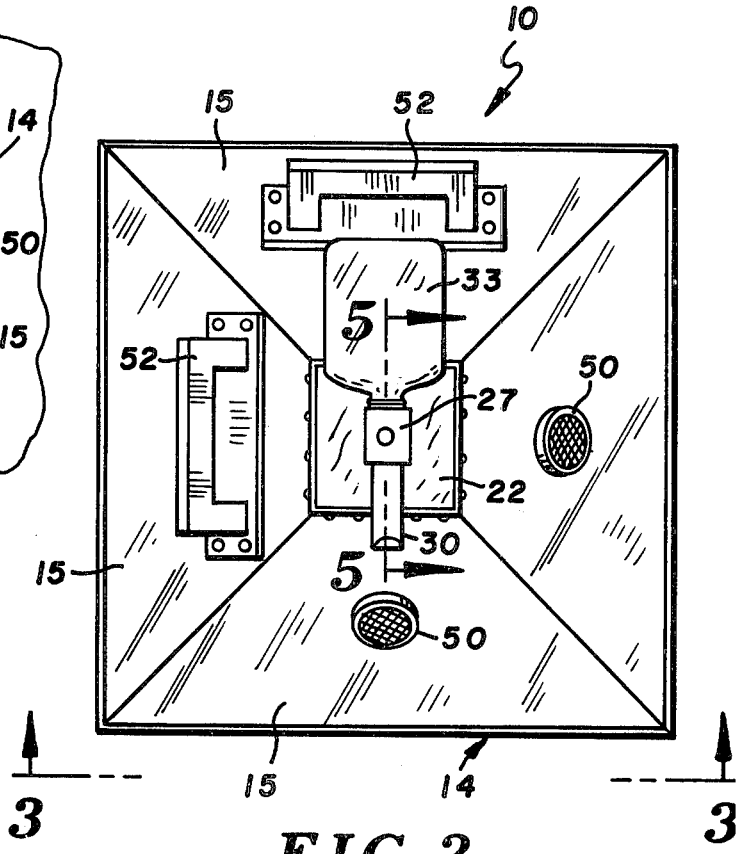
FIG. 2 is an enlarged rear elevational view of the shielded spray apparatus of FIG. 1.
Figure 3:
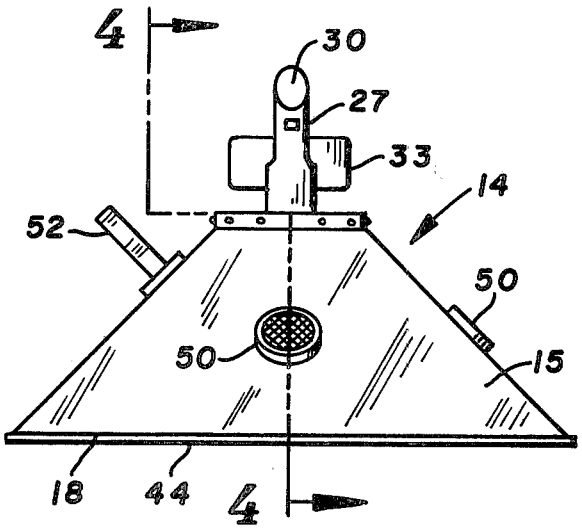
FIG. 3 is a side elevational view of the shielded spray apparatus of FIG. 2 taken along the line 3—3 thereof.

Referring to the drawings, there is shown in FIG. 1 the shielded spray apparatus of the invention indicated generally at 10 being operated by a workman 11 in the process of applying plaster to a wall 12. Apparatus 10 is effective to contain this spray of plaster to wall 12 and prevent plaster from spattering about the wall, or on the workman, into the air and generally about the room. Apparatus 10 is operable to spray acoustic plasters, waterproofing compounds, paint and many other substances. Apparatus 10 is useful in areas of wind where sprayed material would be prone to blow about.

Shielded spray apparatus 10 includes a truncated housing 14 shown generally in the shape of a truncated pyramid formed of four diverging sidewalls 15. Sidewalls 15 can be formed of separate truncated triangular panels suitably joined together or can advantageously be formed as shown by molding of a single piece of material such as a piece of transparent plastic. Sidewalls 15 are preferably transparent and define an interior spray chamber 16. The forward edges 18 of sidewalls 15 define a large planar open end 19 of housing 11 adapted to be disposed adjacent a surface to be sprayed and defining the limits or boundaries of the area to be sprayed while the sidewalls 15 confine the movement of sprayed material to that area.

Sidewalls 15 converge from front opening 19 toward a smaller rear opening 20 that is parallel to and centrally aligned with front opening 19. Rear opening 20 of housing 14 is closed by a flexible diaphragm or panel 22 which can be rubber or plastic or the like. The rear edges of sidewalls 15 have stepped flanges 23 comprised of an outwardly extended leg 23A and a rearwardly extended leg 23B. An inwardly turned flange 24 of panel 22 is disposed adjacent the inner surface of rearwardly extended leg 23B and secured thereto by bolts 25. Bolts 25 pass through the leg 23B, the flange 24 and are threaded into a threaded plate 27 to secure the flexible panel 22 in rear opening 20.

A spray gun 28 is connected to an air line 29 which is in turn connected to an air compressor (not shown) in usual fashion. Spray gun 28 has the normal pistol-grip type handle 30 and an actuating trigger 32. A supply bottle 33 is connected to the body 34 of spray gun 28. Supply bottle 33 contains a supply of plaster or other material to be sprayed through spray gun 28.

Figure 5:
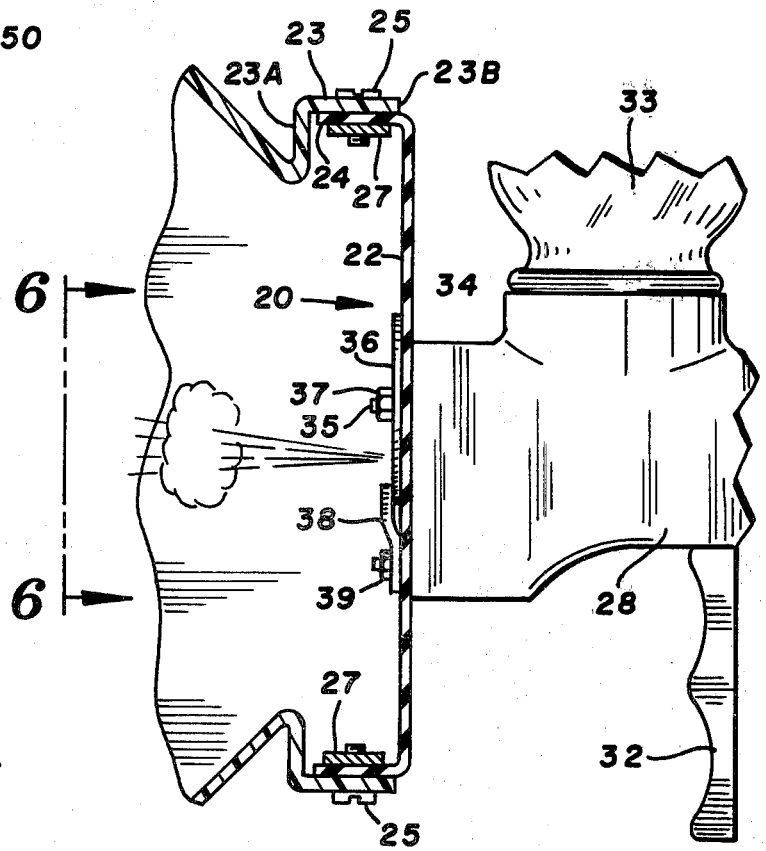
FIG. 5 is an enlarged sectional view of a portion of the shielded spray apparatus as shown in FIG. 4.

An orifice plate 36 is mounted on the front of body 34 of spray gun 28. A nut 37 engages a suitable bolt 35 extending from the front of gun 28 through a mounting hole provided in the orifice plate. A clamp 38 is mounted by a nut and bolt combination 39 beneath orifice plate 36 and extends upwardly to a point where it contacts orifice plate 36 is position to hold it toward the front of gun 28 as best seen in FIG. 5. Orifice plate 36 is rotatable about the axis of nut 37 and has a plurality of different sized holes 41. A jet nozzel 42 is disposed between the nut 37 and the clamp 38 for discharge of material from the gun 28. The respective orifice holes 41 are selectively rotatable into position in front of jet 42 to provide varying spray patterns.

Flexible panel 22 has aperatures to accommodate the bolt 35 and the bolt of the nut and bolt combination 39 as shown in FIG. 5. The spray gun 28 is assembled to the flexible panel 22 with the jet 42 orientated to discharge through an opening in panel 22 into chamber 16 of housing 14 toward front opening 19. A portion of flexible panel 22 is disposed between the front face of body 34 of gun 28 and the orifice plate 36 and clamp 38 with the bolts which are affixed to nuts 37 and 39 extended through the aperatures provided in panel 22. Gun 28 is thus securely fixed with respect to housing 15 in leakproof fashion. By virtue of the flexibility of panel 22, a degree of pointing or aiming the gun is permitted such that the jet 42 can be orientated to discharge at any specific location encompassed by the boundaries of front opening 19.

Figure 6:
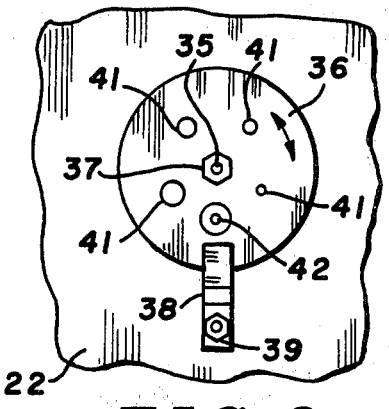
FIG. 6 is a front view of a portion of the shielded spray apparatus of FIG. 5 taken along the line 6—6 thereof.
Figure 7:
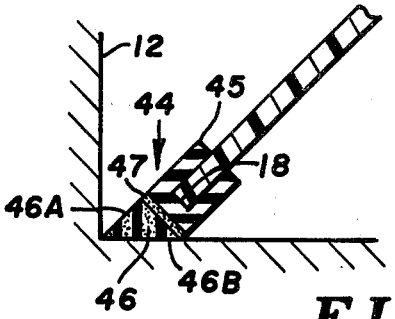
FIG. 7 is an enlarged view in section showing a portion of the interface between a wall and an edge of the housing of the shielded spray apparatus of the invention.

Sidewall edges 18 defining front opening 19 carry a seal 44 to inhibit leakage of sprayed material from the boundaries defining front opening 19. As shown in FIG. 6, seal 44 includes seal molding 45 having a groove engaging the edge 18 of sidewall 15. A resilient seal strip 46 is fixed to the molding 45 as by a glue or adhesive strip 47. Seal strip 46 can be, for example, resilient rubber or the like. Seal strip 46 has sidewalls 46A, 46B converging from molding 45 to a pointed edge. The sidewall 46A facing the interior of housing 14 is parallel to the sidewall 15 of the housing, and the outside sidewall 46B is at an acute angle relative to the inside sidewall 46A such that seal strip 46 conveniently fits in a 90 degree corner as shown in FIG. 7. The wall area down to the apex of the corner is exposed to the front opening 19 and thus exposable to spray from the gun 28.

Figure 4:
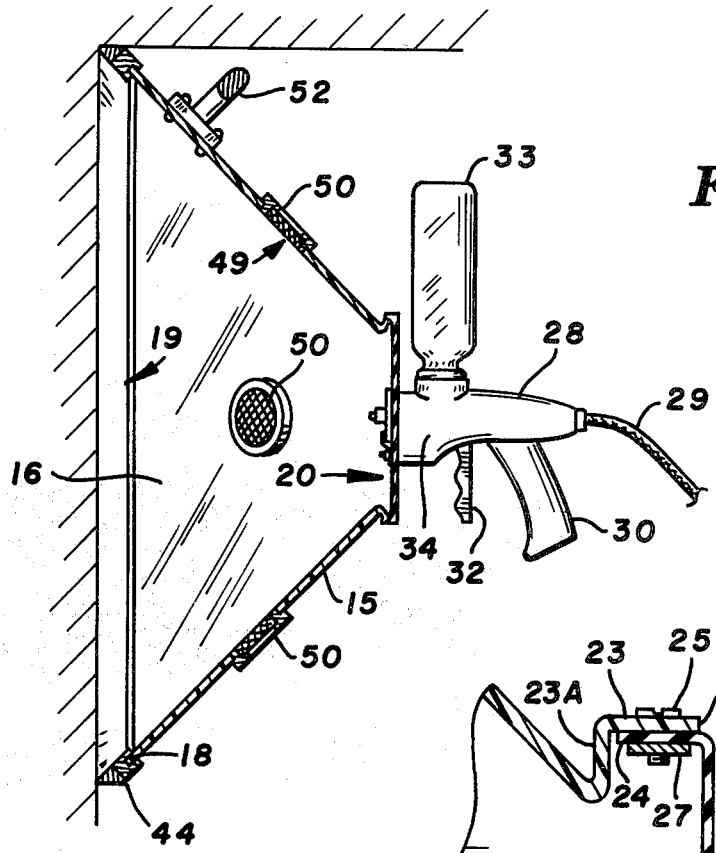
FIG. 4 is a sectional view of the shielded spray apparatus of FIG. 3 taken along the line 4—4 thereof.

As shown in FIG. 4, a plurality of vent openings 49 are located in sidewalls 15 of housing 14 to exhaust air that is replaced by incoming, spray entrained air. The vent openings 49 are closed by filters 50 which clean the vented air of leftover entrained particles before it enters the environment outside of chamber 16.

A plurality of handles 52 are secured at various locations around the housing 14 to be grasped by workman 11 to assist in manipulation of the spray apparatus 10. The handles 52 can be separately attached to the sidewalls 15 as shown, or they can be integrally molded therein when the sidewalls are formed.

In use of the shielded spray apparatus 10 of the invention, the workman 11 grasps the handle 30 of gun 28 in one hand and he can grasp one of the handles 52 in the other hand to lift and position housing 14 with respect to the wall, ceiling or surface to be sprayed. The trigger 32 of gun 28 is actuated in the usual fashion to commence spraying. If the workman is spot spraying as when repairing a particular spot on a wall, the opening 19 is positioned to cover the spot with the seal 44 along the edges 18 of sidewalls 15 isolating the spot to be sprayed. The workman simply then sprays the spot without overspray and without spray getting on the workman, the floor, or other items in the room. If the workman is spraying an entire wall or large surface, he simply actuates the spray and moves the apparatus along the wall or surface. Overspray is confined to the inside surfaces of the sidewalls 15 which can be periodically cleaned. When the workman reaches a corner, the seal 44 is positioned as shown in FIG. 7 and the entire wall down to the apex of the room corner is sprayed. With the housing 14 in any given, fixed position, the workman can manipulate the handle of the gun 28 to point it to the various locations encircled by the edges 18 of sidewalls 15 in order to completely spray the area.

While there has been shown and described one preferred embodiment of the invention, it will be apparent to those skilled in the art that deviations and changes can be had from the embodiments shown without departing from the scope and spirit of the appended claims.

The embodiments of the invention in which an exclusive property or privilege is claimed are defined as follows:

1. A shielded spray apparatus comprising:
housing means having sidewalls defining a spray chamber;
said sidewalls having forward edges defining a planar front opening to the chamber positionable adjacent the surface to be sprayed;
said housing having a planar rear opening to the chamber;
a flexible panel secured to the housing and closing the rear opening;
a spray gun assembled to the flexible panel orientated to direct spray material toward and through the front opening.

2. The shielded spray apparatus of claim 1 including: flexible seal means disposed along said forward edges of the housing sidewalls defining the forward opening to isolate an area of the surface to be sprayed.

3. The shielded spray apparatus of claim 2 wherein: said seal means includes a molding disposed along said forward edges, a flexible seal strip attached to the molding, said flexible seal strip having a pointed outer edge.

4. A shielded spray apparatus comprising:
housing means having sidewalls defining a spray chamber;
said sidewalls having forward edges defining a planar front opening to the chamber positionable adjacent the surface to be sprayed;
said housing having a planar rear opening to the chamber;
a spray gun assembled in the rear opening to the housing orientated to direct spray material toward and through the front opening;
a flexible panel closing the rear opening, said spray gun being assembled to the flexible panel, said flexible panel having a plurality of aperatures for assembly of the spray gun and a spray gun nozzle aperature for operation of the spray gun.

5. The shielded spray apparatus of claim 4 wherein: said housing means comprises a truncated housing with the rear opening smaller than the front opening and parallel to and aligned with the front opening.

6. The shielded spray apparatus of claim 4 wherein: said housing means comprises a truncated pyramid housing with the rear opening smaller than the front opening and parallel to and in alignment with the front opening.

7. The shielded spray apparatus of claim 4 including: flexible seal means disposed along said forward edges of the housing sidewalls defining the forward opening for sealing contact with the surface to be sprayed to isolate an area of the surface to be sprayed.

8. The spray apparatus of claim 5 including: at least one handle connected to the housing adapted to be grasped by an operator for manipulation of the housing.

9. The spray apparatus of claim 6 including: a plurality of vent openings in the sidewalls of said housing, said vent openings being closed by filters to permit passage of air from within the chamber to a location outside of the chamber.

10. The shielded spray apparatus of claim 4 including: at least one handle connected to the housing adapted to be grasped by an operator for manipulation of the apparatus.

11. A shielded spray apparatus comprising:

housing means having transparent sidewalls assembled in the form of a truncated pyramid defining a spray chamber, said sidewalls having forward edges defining a planar front opening to the chamber positionable adjacent the surface to be sprayed, and having rear edges defining a smaller rear opening to the chamber parallel to and in alignment with the front opening;

a spray gun assembled in the rear opening of the housing orientated to direct spray material toward and through the front opening;

at least one handle connected to the housing adapted to be grasped by an operator for manipulation of the housing;

a plurality of vent openings in the sidewalls of said housing, said vent opening being closed by filters to permit passage of air from within the chamber to a location outside of the chamber; and flexible seal means disposed along said forward edges of the housing sidewalls defining the forward opening to isolate an area of a surface to be sprayed, said seal means including a seal strip having seal strip sidewalls converging to form a pointed edge, said seal strip sidewall facing the interior of the housing being parallel to the sidewalls of the housing with the outside seal strip sidewall at an acute angle relative to the inside seal strip sidewall such that the strip conveniently fits in a 90° corner.

12. The shielded apparatus of claim 11 wherein: said seal means includes a molding disposed along said forward edges of the sidewalls defining the front planar opening, said seal strip being attached to the molding.

* * * * *